US006082643A

United States Patent [19]

Kovacs

[11] Patent Number: 6,082,643

[45] Date of Patent: Jul. 4, 2000

[54] WASTE DISPOSER SAFETY DEVICE

[75] Inventor: Walter Kovacs, Orange, Calif.

[73] Assignee: Anaheim Manufacturing Company, Anaheim, Calif.

[21] Appl. No.: 09/146,062

[22] Filed: Sep. 2, 1998

Related U.S. Application Data

[60] Provisional application No. 60/057,454, Sep. 3, 1997.

[51] Int. Cl.[7] ..... B02C 25/00

[52] U.S. Cl. ..... 241/36; 241/37.5; 241/46.016

[58] Field of Search ..... 4/DIG. 4; 241/DIG. 38, 241/37.5, 36, 46.013, 46.014, 46.015, 46.016

[56] References Cited

U.S. PATENT DOCUMENTS

| | | | |
|---|---|---|---|
| 2,700,509 | 1/1955 | Powers | 241/37.5 |
| 3,014,515 | 12/1961 | Meeker et al. | 241/37.5 |
| 5,773,281 | 6/1998 | Ichikawa et al. | 4/DIG. 4 |

FOREIGN PATENT DOCUMENTS

| | | | |
|---|---|---|---|
| 54-7770 | 1/1979 | Japan | 241/37.5 |

*Primary Examiner*—Mark Rosenbaum
*Attorney, Agent, or Firm*—Evanns & Walsh; Joseph R. Evanns

[57] ABSTRACT

A waste disposer safety device comprises a first member positionable adjacent access to a waste disposer and a second member with access restriction, the first and second members being rotatable with respect with one another to achieve an "off" position and an "on" position whereby in the "on" position, in which operation of the waste disposer is enabled, there is no hazardous access to the grinding chamber thereof, and an "off" position in which the second member can be removed for access to the grinding chamber whereby in that position the grinder motor is inoperable. Switches for accomplishing the on/off condition of the first member and second member and of the waste disposer may be electromechanical or magnetic, among other types of switches.

22 Claims, 8 Drawing Sheets

MAGNET ACTUATED POSITION

WASTE DISPOSER SAFETY DEVICE

This application claims the benefit of U.S. Provisional Application No.: 60/057,454 Sep. 3, 1997.

BACKGROUND OF THE INVENTION

1. Field of the Invention

The invention pertains and relates to safety devices for waste disposal systems.

2. Description of the Prior Art

Food waste disposer systems such as garbage disposer systems and the like, are devices for mounting under the discharge opening of a sink for disposing of food waste. Such disposal comprises grinding the waste into particulate matter for flushing into the sewer. In existing devices, grinding is commonly accomplished with a motor driven turntable which causes waste from the sink to be thrust by centrifugal force against cutting edges referred to as grind rings. The latter are conventionally positioned around the perimeter of the turntable. In connection with cutting, impellers secured to the turntable contribute to urging the food waste against the grind ring. A flow of water through the grinding chamber flushes the particles from the grind ring into the sewer.

Normally, the connector between the sink and the disposer unit may have an opening ranging from approximately 3 inches in diameter to approximately 8 inches in diameter. Even the smallest connector opening will permit hands of most sizes to reach through it to the grinding chamber with possible contact between the hand and the turntable or the grind ring. Under most circumstances such events can occur though there is no objective basis for doing so when the disposer is in operation. However, such entry into the grinding chamber occurs on some of the more common bases: attempting to clear the grinding chamber of a food particles not eliminated; for the purpose of forestalling decay and/or malodorous conditions; attempting to clear a jam under a swivel impeller to eliminate excessive vibration; attempting to clear a turntable jam caused by food particles lodged between it and a grind ring or the grinding chamber; and in-advertence/carelessness.

Usually most attempts to insert hands into a grinding chamber occur when the disposer motor is not operating; however, the possibility always exists for the disposer to be turned on inadvertently while the hand is at risk, resulting in injuries which may be serious.

Therefore, safety devices have been developed to limit inappropriate access to the grinding chamber. One such device is a batch feed adapter. This type of device is commonly used with small sink openings. With this device, the disposer motor is actuated by a switch which in turn is operated by a device which also acts as a stopper. In operation, this type of device is initially loaded with food waste and the motor is energized upon insertion of a stopper/actuator, resulting in a grinding process whereby though water is permitted to flow into the disposer during the grinding process, additional waste cannot be added without removing the access-limiting device.

Another existing device permits continuous feeding of food waste, as opposed to the device above described, by placing restriction devices between the sink and the disposer. Such devices are permanently installed and have the disadvantage that reasonable and necessary access (as by repairmen, for example) to the grinding chamber can only be achieved by dismantling the installation.

A substantial majority of existing disposers have no provision for limiting unsafe entry into the grinding chamber.

Therefore, there has been a felt but unfulfilled need for a safety device for a waste disposer which permits a continuous feed of waste and does not require dismantling of the installation for the purpose of accommodating legitimate needs for access into the grinding chamber.

SUMMARY OF THE INVENTION

A waste disposer safety device comprises a first member mountable upon a sink and a second member with access restriction, the first and second members being rotatable with respect with one another to achieve an off position and an on position whereby in the on position there is operation of the grinder such that no hazardous access to the grinding chamber can be effected, and an off position in which the second member can be removed for access to the grinding chamber whereby in that position the grinder motor is off. Switches for accomplishing the on/off condition of the first member and second member and of the grinder motor may be electro-mechanical or magnetic, among other types of switches.

DETAILED DESCRIPTION OF THE INVENTION

Figure 1:
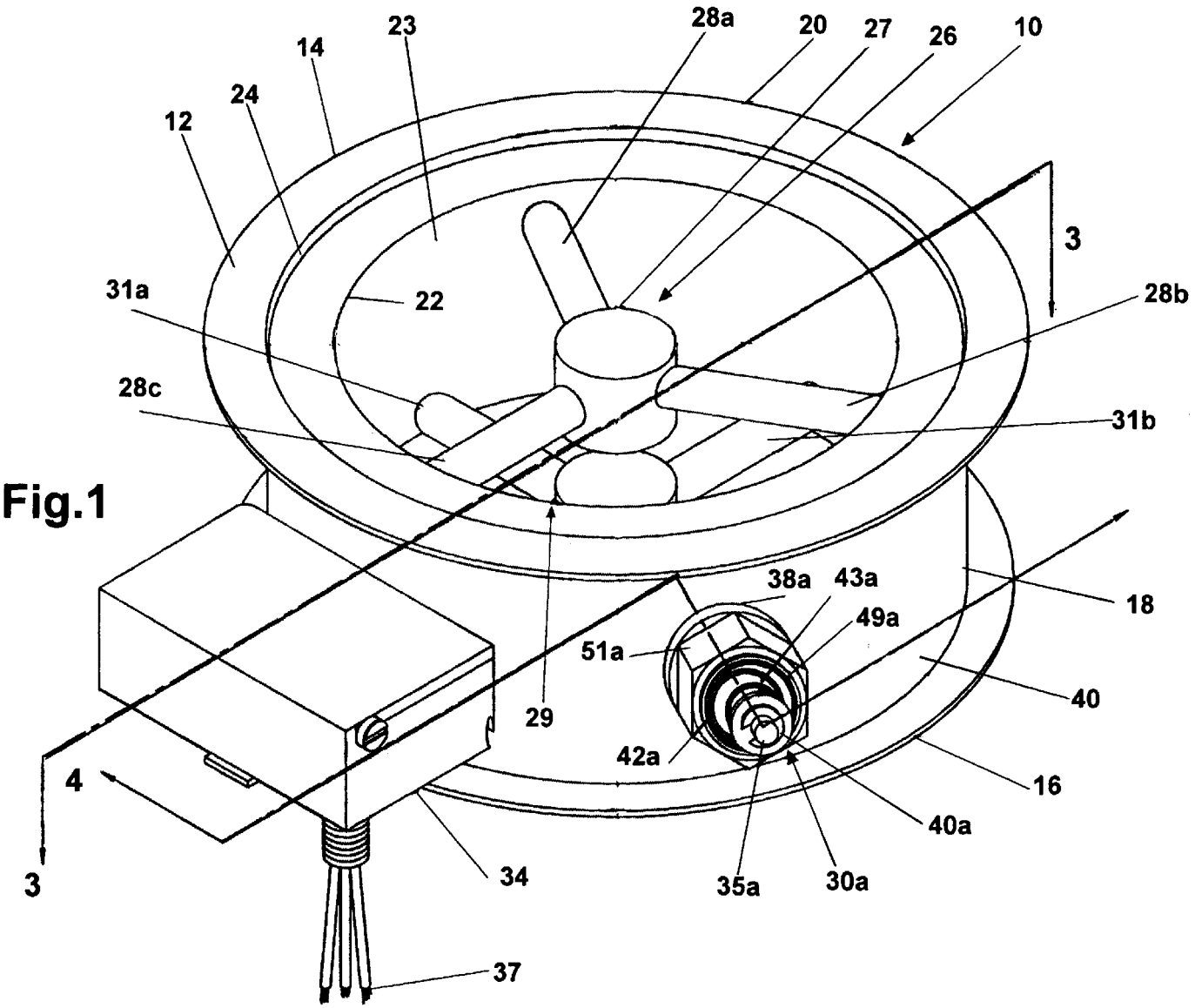
FIG. 1 is a perspective view of a waste disposer safety device in accordance with the invention.
Figure 2:
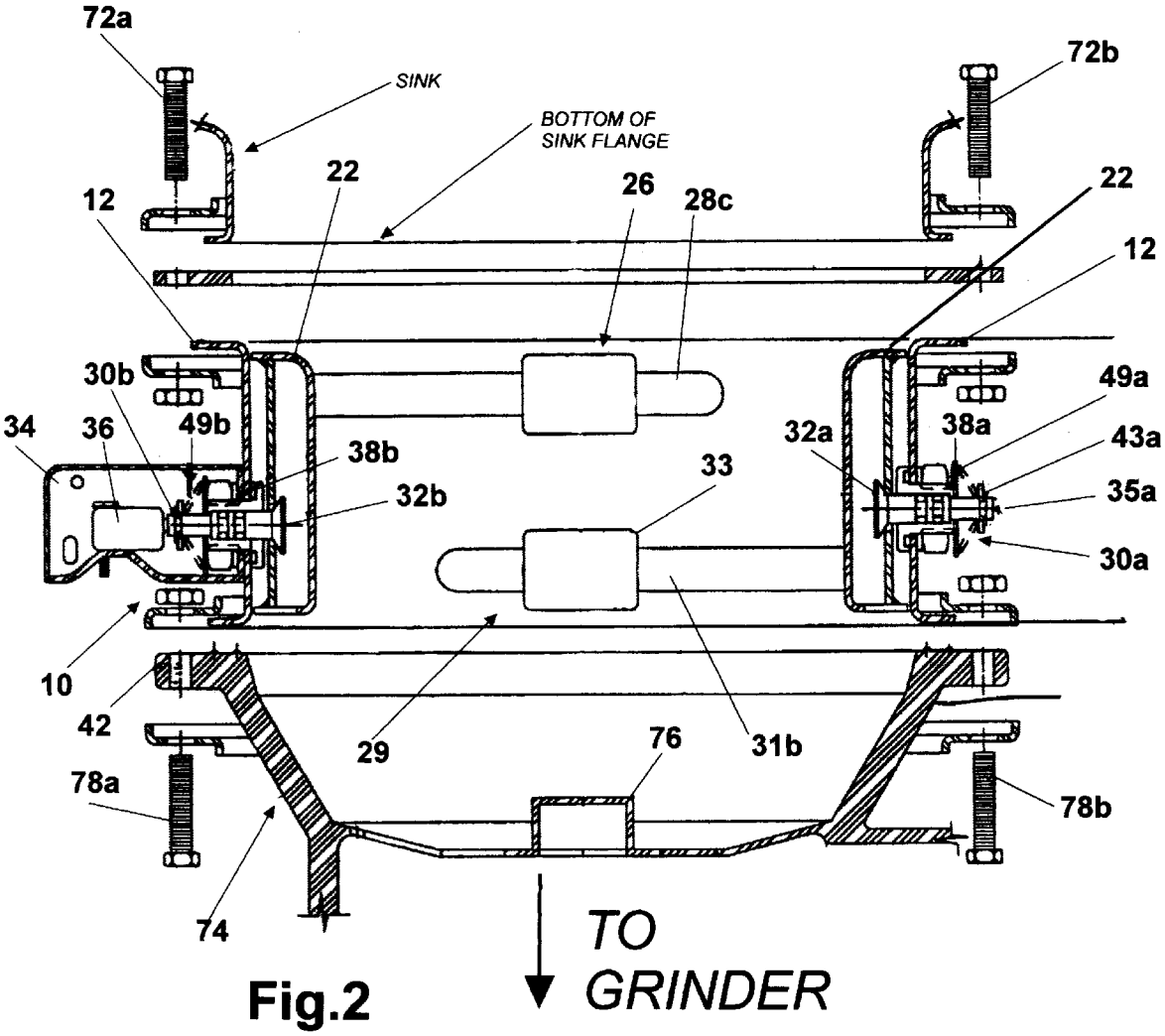
FIG. 2 is a side view, broken away, of a waste disposer safety device depicting it in connection with a sink installation.
Figure 3:
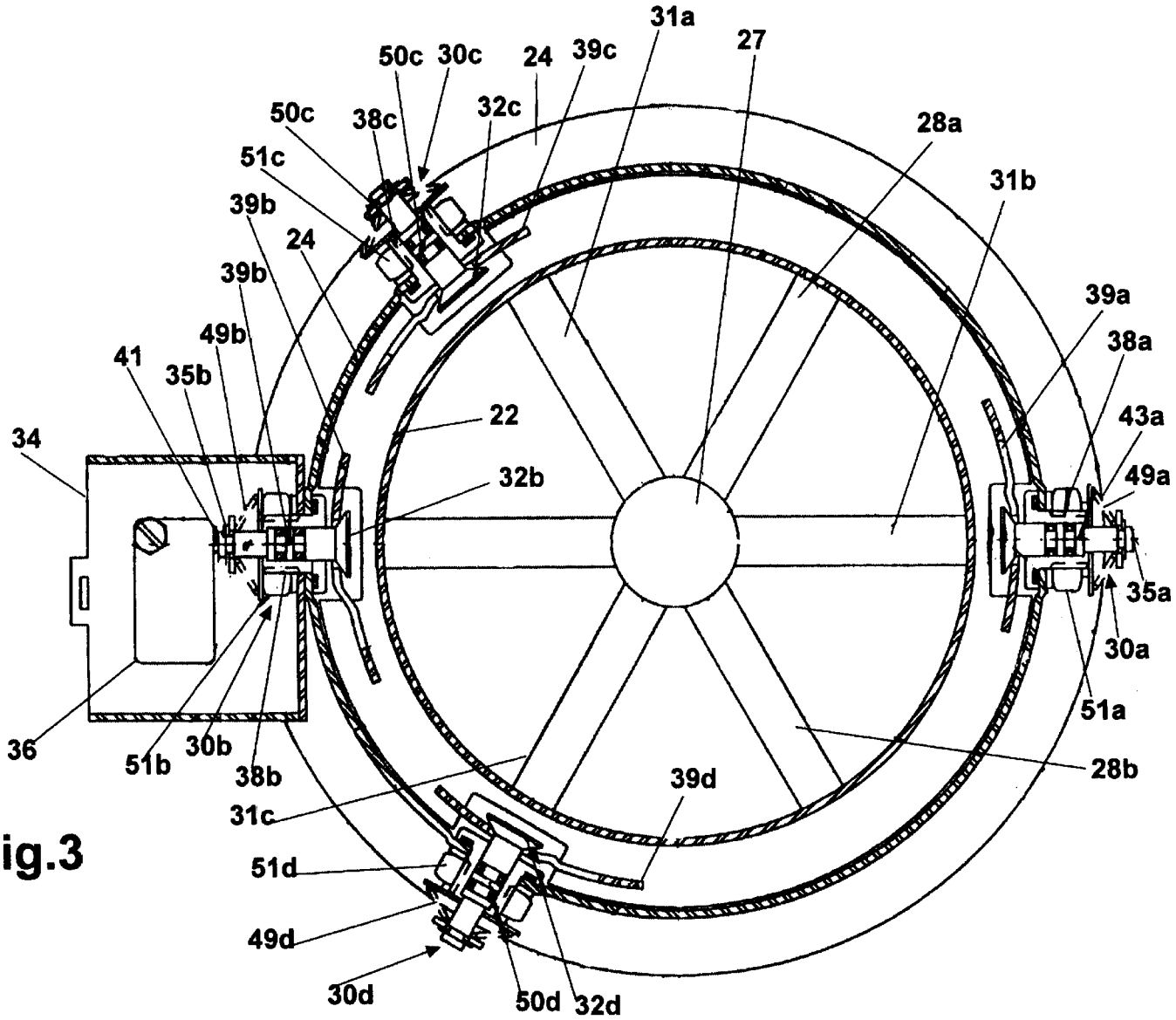
FIG. 3 is a sectional view through the line 3—3 of FIG. 1, depicting the device in an installed/off position with a particular type of electrical power supply control switch.

As depicted in FIGS. 1–3; inclusive, a waste disposer safety device 10, in accordance with the invention, comprises a mounting collar 12, including an upper ring 14, a lower ring 16 and a connecting wall 18 forming a housing 20.

FIG. 2 depicts disposer safety device 10 in place in a typical sink installation. Disposer safety device 10 is bolted by bolts 72*a*, 72*b* to a sink through the bottom of the sink flange.

Disposer safety device 10 is bolted to a disposer 74 by bolts 78*a*, 78*b*. Disposer 74 includes a connector 76 which gives access to a grinder and grinder chamber (both not shown); in turn, the grinding chamber connects to the sewer system (not shown).

Disposed within housing 20 is a guard ring 22 adjacent an interior surface 24 of housing 20. In the depicted embodiment, mounting collar 12 and guard ring 22 comprise annular configurations and are depicted in this manner for specificity, other configurations being usable in accordance with the invention. Positioned at substantially side-to-side mid-point in collar 12 and guard ring 22 is a restrictor member 26. Member 26 comprises a hub 27 on which are mounted a plurality (depicted herein as three) of restrictor arms 28*a*, 28*b*, 28*c*. Greater or lesser numbers of restrictor arms may be employed in particular applications in accordance with the invention.

Restrictor arms 28*a*, 28*b*, 28*c* are disposed at angular displacements substantially equal to 120° and are secured at their outer ends to an interior surface 23 of guard ring 22. The distance between respective pairs of arms 28*a*, 28*b*, 28*c* may be selected to accord with the particular safety considerations which are applicable. If, for example, the risk of unauthorized insertion of a hand into the disposer 10 is from small children, the distance between pairs of arms 28*a*, 28*b*, 28*c* can be made as small as necessary, even as small as three (3) inches or less. For other classes of persons at risk, the distances can be made larger. The existence of spaced apart pairs of restrictor arms affords the opportunity for continuous feed of waste material while at the same time preventing unauthorized access to the interior of disposer 10.

Disposed within housing 20 and axially below restrictor member 26 is a lower restrictor member 29. Lower restrictor 29 comprises a lower hub 33 to which are secured in the same manner as with upper hub 27 a plurality (as depicted, three) of restrictor arms 31*a*, 31*b*, 31*c*. The latter restrictor arms are positioned in the same manner as restrictor arms 28*a*, 28*b*, 28*c* in that they are secured to inner wall 23 of guard ring 22 and are positioned at angular intervals substantially equal to 120°. The combination of upper restrictor 26 and lower restrictor 29 provides safety preventing inappropriate access into the interior or disposer 74. Greater or lesser numbers of restrictors may be provided in particular applications in accordance with the invention.

Mounted in bushings 38*a*, 38*b*, 38*c*, and 38*d* in wall 18 of housing 20 are plunger assemblies 30*a*, 30*b*, 30*c*, 30*d*, respectively. Plunger assemblies 30*a*, 30*b*, 30*c*, 30*d* are identical in shape and structure to one another; therefore, the description given herein of particular parts of one particular plunger assembly will be equally applicable to all other plunger assemblies herein.

Plunger assembly 30*a* comprises a posterior plunger element 32*a* which is connected to an anterior plunger element 35*a*. A snap ring 40*a*, a washer 43*a*, a nut 51*a* and a spring 49*a* encapsulate and retain plunger assembly 30*a*, which is mounted in bushings 38*a*. Plunger assembly 30*a* includes O-rings 50 disposed between elements 32*a*, 35*a*. A plurality of detents 39*a*, 39*b*, 39*c*, 39*d* are mounted on guard ring 22 to be engageable with members 32*a*, 32*b*, 32*c*, 32*d*, respectively.

A switch housing 34 is mounted upon mounting collar 12. Disposed within housing 34 is a limit switch 36 of conventional type electrically coupled to leads 37 which are connected to the electrical system for disposer 74 supplying electrical power for grinding waste matter. Switch 36 comprises a limit switch including a switch actuator 41 extending outwardly. Switch 36 is arranged such that when switch actuator 41 is thrust inwardly switch 36 assumes the off condition and when switch actuator 41 is not so thrust, switch 36 is in the on condition. In the on condition, power is provided through leads 37 for grinding waste in disposer 74 under control of an on/off switch (not shown) of disposer 74.

Figure 4:
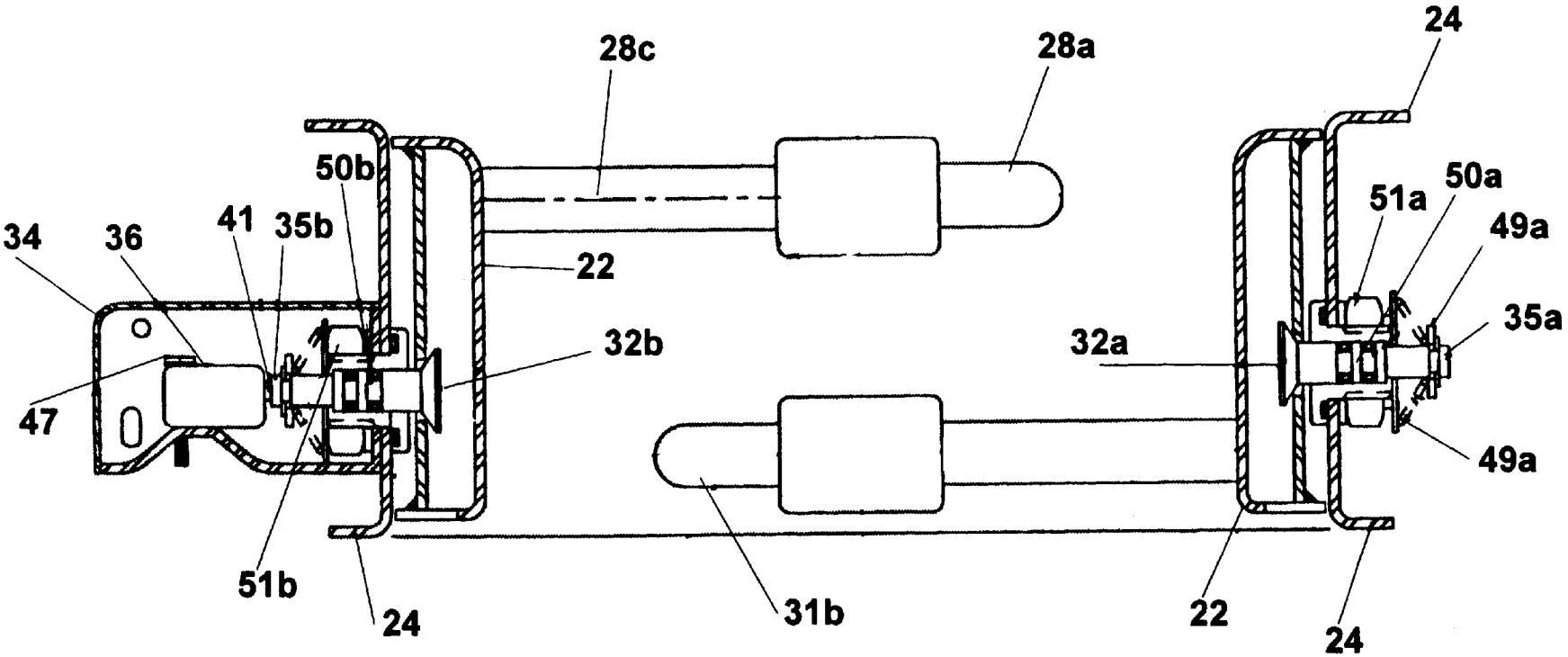
FIG. 4 is an enlarged fragmentary view of a sectional view along the line 3—3 of FIG. 1.
Figure 5:
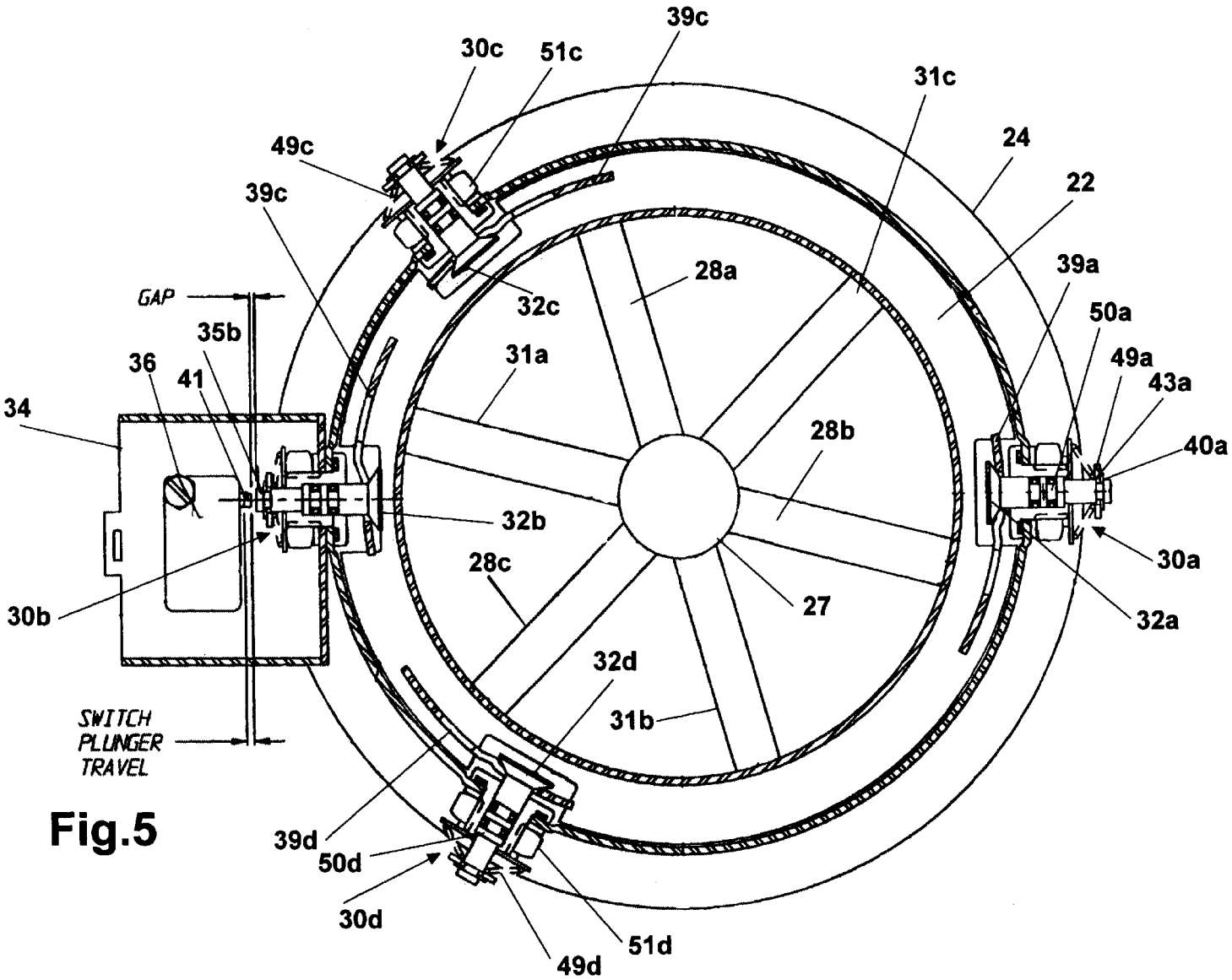
FIG. 5 is a sectional view along the line 3—3 of FIG. 1 depicting the invention in installed/on configuration.

Depicted in FIG. 3 is disposer safety device 10 with switch 36 in the off condition and in FIG. 4 detail is shown of the relative positions of mounting collar 12 and guard ring 22 to accomplish the off condition of switch 36. In FIG. 5 is depicted the relative positioning of mounting collar 12 and guard ring 22 to accomplish the on condition of switch 36.

As depicted in FIG. 5, guard ring 22 is positioned with respect to mounting collar 12 such that plunger assemblies 30*a*, 30*b*, 30*c*, 30*d*, are in contact with detents 39*a*, 39*b*, 39*c*, 39*d*, respectively through members 32*a*, 32*b*, 32*c*, 32*d*, respectively, such that guard ring 22 and mounting collar 12 are locked together by contact between plungers and detents; in the depicted orientation, plunger assembly 30*b*, is in an unextended position due to its positioning on detent 39*b*. In this position, plunger assembly 30*b* which is adjacent switch actuator 41, is not in contact with the latter, thus causing switch 36 to assume the on position whereby power may be provided for grinding by the disposer 74, under control of an on/off switch (not shown) on disposer 74.

As shown in FIGS. 3, 4, switch 36 is in the off condition. Guard ring 22 has been rotated relative to mounting collar 12, away from the on position depicted in FIG. 5, to the off position. Through such rotation, plunger assembly 32*b* is brought to an extended position through contact with the appropriate part of detent 39*b*, as a result of which plunger member 32*b* acts to press inwardly actuator 41 of switch 36. This causes switch 36 to assume the off position whereby no power is provided for grinding through leads 37 to disposer 74.

In the on position, power is provided for grinding by disposer 74 of waste matter into particulates. At the same time, the presence of guard ring 22 with its restrictors 26, 29 prevents access to the interior of the disposer 74 during operation thereof. In the same manner, guard ring 22 in the off position, prevents access; however, guard ring 22 may be readily removed by simply rotating it further counterclockwise from its position in FIG. 5, thereby disengaging plunger assemblies 30*a*, 30*b*, 30*c*, 30*d* from their respective detents 39*a*, 39*b*, 39*c*, 39*d* such that guard ring 22 may be lifted off the disposer safety device 10 enabling safe access to machinery which is not operating.

Figure 6:
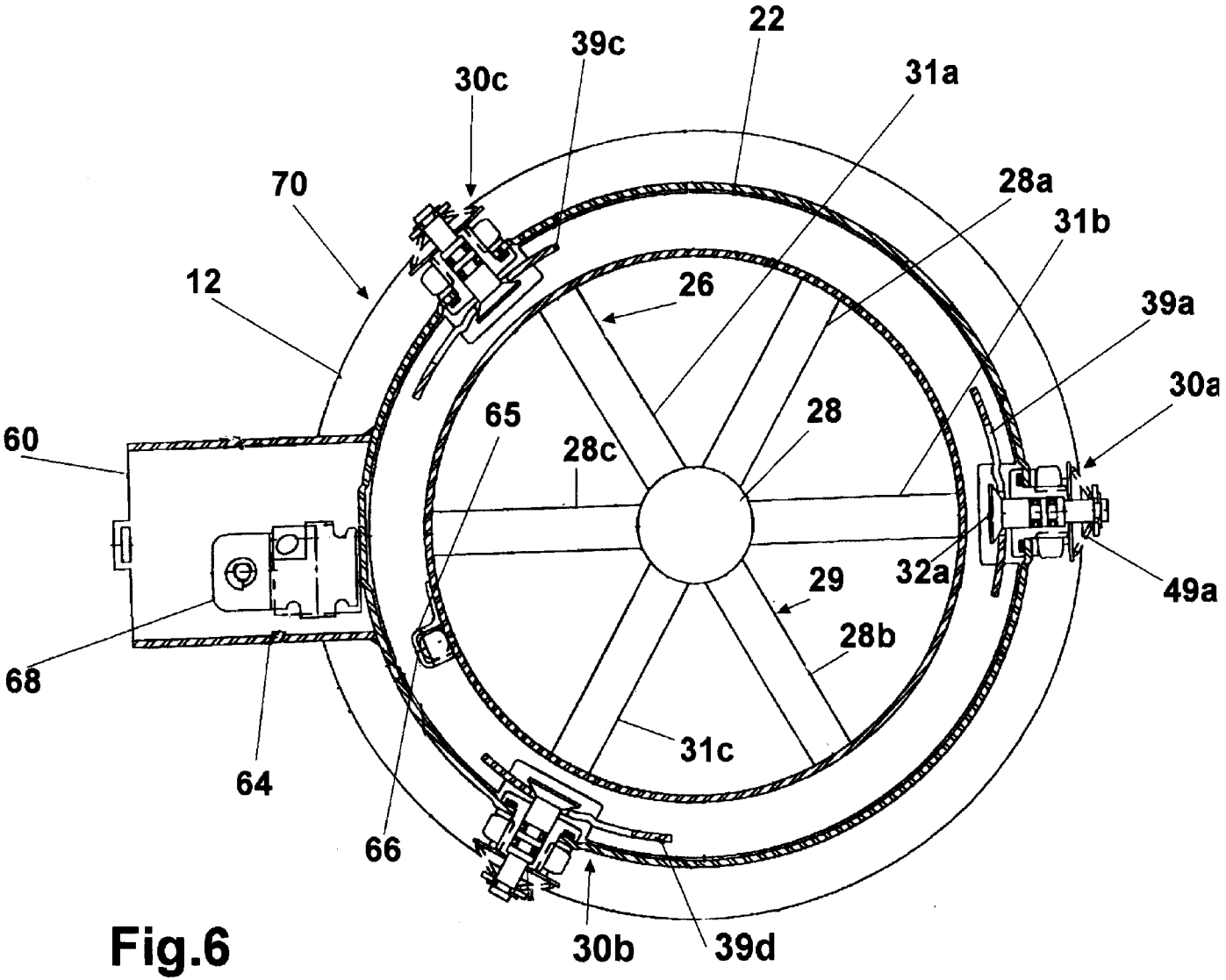
FIG. 6 is an alternative embodiment of the invention depicting a sectional view along the line 3—3 of FIG. 1, with an alternative switching assembly in the off position.
Figure 7:
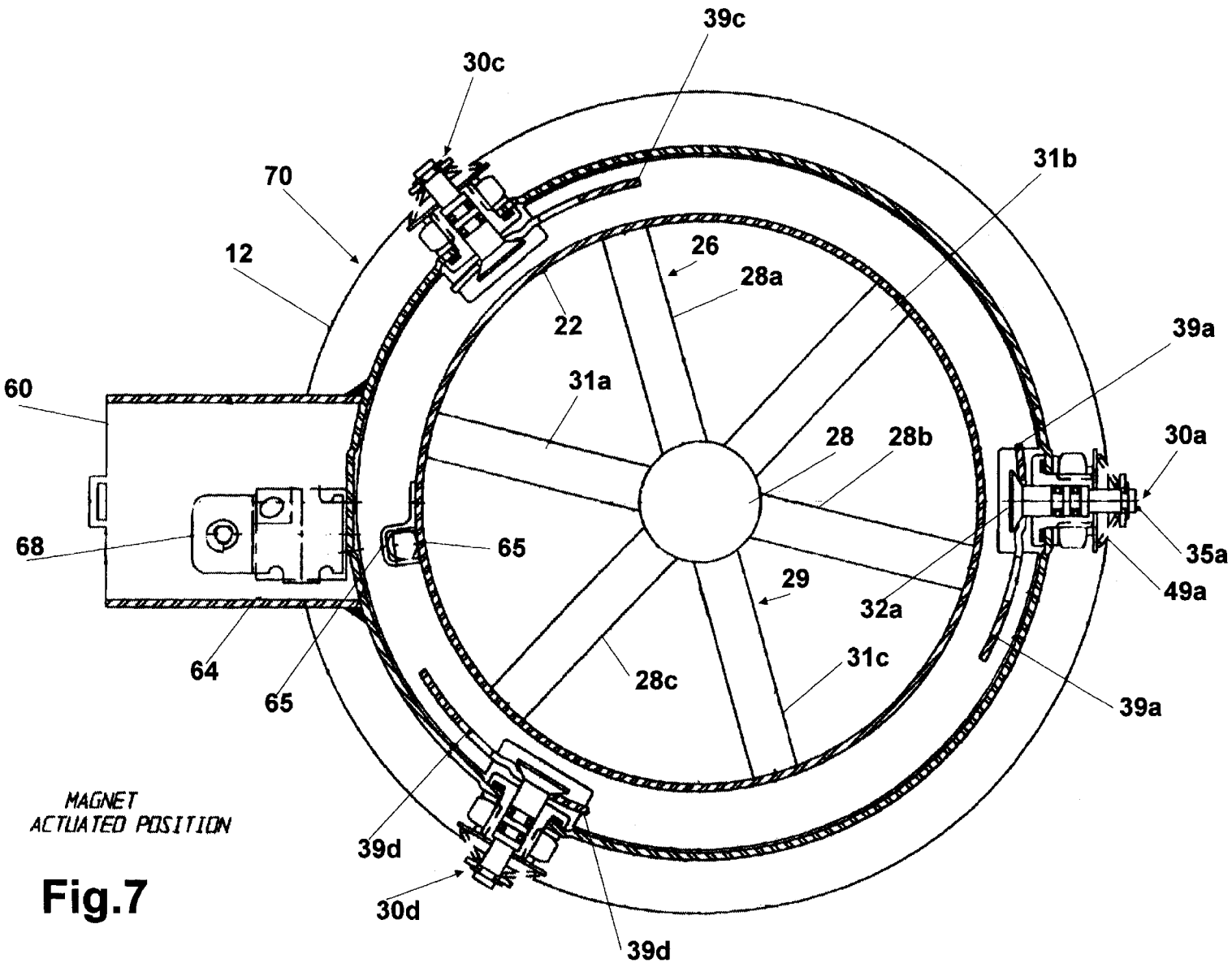
FIG. 7 is a sectional view through line 3—3 of FIG. 1 depicting the switching arrangement of FIG. 6 in the on position.
Figure 8:
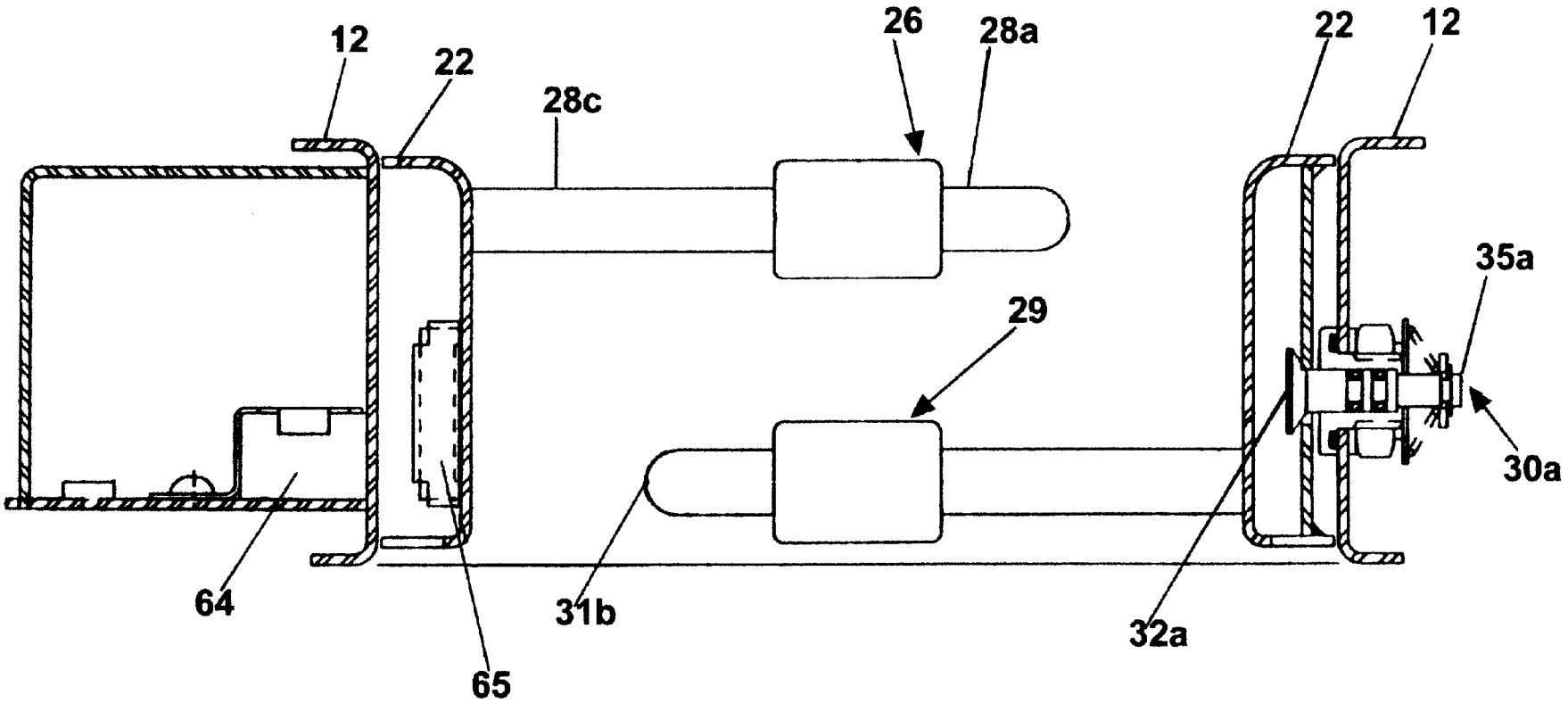
FIG. 8 is an enlarged fragmentary sectional view along the line 4—4 of FIG. 1 depicting detail of the alternative switching arrangement depicted in FIG. 6.

Depicted in FIGS. 6–8, inclusive, is a disposer safety device 70 which is distinguished from disposer safety device 10 depicted in FIGS. 1–5, inclusive, in that the switch assemblies for controlling the on/off condition of the operation of the respective disposers are different. In description of the embodiment of FIGS. 6–8, inclusive, therefore, corresponding parts will be given the same reference numerals and only different parts as between the two embodiments, will be given different reference numerals.

Disposer safety device 70 includes plunger assemblies 30*a*, 30*c*, 30*d* in the same manner and with the same function as the corresponding plunger assemblies depicted and described in connection with FIGS. 1–5. Also included in safety device 70 are detents 39*a*, 39*c*, 39*d* identical to those depicted and described in connection with the embodiment of FIGS. 1–5, inclusive.

Safety device 70 includes mounting collar 12 and guard ring 22. Mounted on guard ring 22 is a bracket 65 which secures a magnet 66.

Mounted on mounting collar 12 is a housing 60 containing a magnetically actuated reed switch 64. Reed switch 64 is held in place by a bracket 68. Reed switch 64 and its components are of standard type.

As in the embodiment depicted and described in connection with FIGS. 1–5, inclusive, guard ring 22 is equipped with restrictors 26, 29 including a total of six restrictor arms 28*a*, 28*b*, 28*c*, 31*a*, 31*b*, 31*c*, respectively. In the off position depicted in FIG. 6, a magnet 66 is disposed sufficiently distantly from reed switch 64 that switch 64 is in the off condition. This is the installing position whereby prior to further manipulation, the disposer safety device 70 cannot receive power to grind waste matter into particulates.

As shown in FIGS. 7, 8, the disposer safety device 70 operates in the on condition whereby guard ring 22 has been rotated with respect to mounting collar 12 such that magnet 66 has sufficient proximity to reed switch 64 that the latter is in the on condition whereby power is supplied to disposer 74 for grinding waste matter via a solenoid-operated relay (not shown).

In the on condition of the embodiment of FIGS. 6–8, inclusive, as in the first discussed embodiment the presence of guard ring 22 with its access-blocking restrictors prevents unauthorized access to the interior of the disposer safety device 70 during grinding of waste matter.

In order to obtain access to the interior of the device, it is necessary to rotate the guard ring 22 counterclockwise in order to deactivate reed switch 64 and to disengage guard ring 22 from detents 39*a*, 39*c*, 39*d* thereby enabling guard ring 22 to be separated from the remainder of the device.

In the foregoing embodiments, electromechanical switching (FIGS. 1–5) and magnetic switching (FIGS. 6–8) have been depicted and described. This is by way of illustration only and not by way of limitation, other switching mechanisms being employable in accordance with the invention.

Therefore, in accordance with the invention, a waste disposer safety device is provided which affords the capability of performing the grinding function of a waste disposer while restricting unauthorized access into the interior of the disposer during grinding and affords ready access to the interior of the disposer upon cessation of grinding.

Particular embodiments of the invention have been described and depicted herein. The invention is defined by claims to be filed according to law and to be interpreted in light of the specification and drawings.

What is claimed is:

1. A waste disposer safety system for use with an electrically controlled waste disposer having access for intake of waste and operable to dispose of same comprising:

(a) a first member positionable adjacent said intake access to said waste disposer, said first member including switch means electrically connectable to said waste disposer and having an "on" and "off" condition, such that in the "on" condition said waste disposer is operable and in the "off" condition said waste disposer is inoperable;

(b) a second member including switch actuator means for actuating said switch means and restrictor means for restricting hazardous access to said waste disposer, said second member and said first member being relatively movable with respect to each other to an "on" position such that in the "on" position said switch means is in the "on" condition whereby power may be provided for operation of said waste disposer.

2. The invention as set forth in claim 1 wherein in the "on" position, said first member and said second member are engaged together such as to prevent disengagement thereof except by movement away from said "on" position.

3. The invention as set forth in claim 2 wherein said switch actuator means and said switch means are engageable with each other to substantially lock said first member and said second member together upon engagement thereof in said "on" position.

4. The invention as set forth in claim 2 wherein said second member is positionable substantially within said first member and is removeable therefrom except in the "on" position.

5. The invention as set forth in claim 2 wherein said switch actuator means comprises least one plunger member and said switch means comprises at least one detent member.

6. The invention as set forth in claim 2 wherein said switch means comprises a limit switch for said waste disposer, which operates under the control of a disposer switch having an "on" and "off" condition such that when said switch means is in the "off" condition the waste disposer is inoperable regardless of the condition of said switch of said waste disposer.

7. The invention as set forth in claim 2 wherein said switch means is magnetically actuable and said switch actuating means includes a source of magnetism whereby in said "on" position magnetism from said switch actuating means actuates said switch means to said "on" condition.

8. The invention as set forth in claim 1 wherein said relative motion between said first member and said second member is substantially circular.

9. The invention as set forth in claim 1 wherein said restrictor means comprises at least one restrictor arm.

10. The invention as set forth in claim 1 wherein said restrictor means includes at least one hub member and comprises a plurality of restrictor arms disposed upon said at least one hub member.

11. The invention as set forth in claim 1 wherein said second member is removable when said switch means is not in the "on" position, to give access to said waste disposer.

12. The invention as set forth in claim 1 wherein said switch means is electrically operable.

13. The invention as set forth in claim 1 wherein said switch means is magnetically-actuated.

14. The invention as set forth in claim 1 wherein said second member includes second restrictor means comprising at least one access-restricting arm.

15. The invention as set forth in claim 1 wherein said first member is detachably attachable to said waste disposer.

16. The invention as set forth in claim 1 herein said first member is detachably attachable to a receptacle in which said waste disposer may be disposed.

17. A waste disposer system preventing hazardous access comprising:

(a) a grinder;

(b) access means providing access for intake of waste for grinding by said grinder;

(c) a first member positionable adjacent said access means, said first member including switch means electrically connectable to said grinder and having an "on" and "off" condition, such that in the "on" condition said grinder is operable and in the "off" condition said grinder is inoperable;

(d) a second member including switch actuator means for actuating said switch means and restrictor means for preventing hazardous access to said grinder, said second member and said first member being relatively movable with respect to each other to an "on" position such that in the "on" position said switch means is in the "on" condition whereby power may be provided for operation of said grinder, said first member and said second member being engaged together in the "on" position such as to prevent disengagement thereof except by movement away from said "on" position, said switch actuator means and said switch means being engageable with each other to substantially lock said first member and said second member together upon engagement thereof in said "on" position.

18. A waste disposer system preventing hazardous access comprising:

(a) a grinder;

(b) access means providing access for intake of waste for grinding by said grinder;

(c) a first member positionable adjacent said access means, said first member including switch means electrically connectable to said grinder and having an "on" and "off" condition, such that in the "on" condition said grinder is operable and in the "off" condition said grinder is inoperable; and (d) a second member including switch actuator means for actuating said switch means and restrictor means for preventing hazardous access to said grinder, said second member and said first member being relatively movable with respect to each other to an "on" position such that in the "on" position said switch means is in the "on" condition whereby power may be provided for operation of said grinder, said first member and said second member being engaged together in said "on" position such as to prevent disengagement thereof except by movement away from said "on" position, said second member being positionable substantially within said first member and being removable therefrom except in the "on" position.

19. A waste disposer system preventing hazardous access comprising:

(a) a grinder;

(b) access means providing access for intake of waste for grinding by said grinder;

(c) a first member positionable adjacent said access means, said first member including switch means electrically connectable to said grinder and having an "on" and "off" condition, such that in the "on" condition said grinder is operable and in the "off" condition said grinder is inoperable; and (d) a second member including switch actuator means for actuating said switch means and restrictor means for preventing access to said grinder, said second member and said first member being relatively movable with respect to each other to an "on" position such that in the "on" position said switch means is in the "on" condition whereby power may be provided for operation of said grinder, said first member and said second member being engaged together in the "on" position such as to prevent disengagement thereof except by movement away from said "on" position, said switch actuator means comprising at least one plunger member and said switch means comprising at least one detent member.

20. A waste disposer system preventing hazardous access comprising:

(a) at least one grinder;

(b) access means providing access for intake of waste for grinding by said at least one grinder;

(c) a first member positionable adjacent said access means, said first member including switch means electrically connectable to said at least one grinder and having an "on" and "off" condition, such that in the "on" condition said at least one grinder is operable and in the "off" position said at least one grinder is inoperable; and (d) a second member including switch actuator means for actuating said switch means and restrictor means for preventing hazardous access to said access means, said second member and said first member being relatively movable with respect to each other to an "on" position such that in the "on" position said switch means is in the "on" condition whereby power may be provided for operation of said at least one grinder, said restrictor means comprising at least one restrictor arm.

21. A waste disposer system preventing hazardous access comprising:

(a) a grinder;

(b) access means providing access for intake of waste for grinding by said grinder;

(c) a first member positionable adjacent said access means, said first member including switch means electrically connectable to said grinder and having an "on" and "off" condition, such that in the "on" condition said grinder is operable and in the "off" condition said grinder is inoperable; and (d) a second member including switch actuator means for actuating said switch means and restrictor means for preventing hazardous access to said grinder, said second member and said first member being relatively movable with respect to each other to an "on" position such that in the "on" position said switch means is in the "on" condition whereby power may be provided for operation of said grinder, said restrictor means including at least one hub member and comprising a plurality of restrictor arms disposed upon said at least one hub member.

22. A waste disposer system preventing hazardous access comprising:

(a) a grinder;

(b) access means providing access for intake of waste for grinding by said grinder;

(c) a first member positionable adjacent said access means, said first member including switch means electrically connectable to said grinder and having an "on" and "off" condition, such that in the "on" condition said grinder is operable and in the "off" condition said grinder is inoperable; and (d) a second member including switch actuator means for actuating said switch means and restrictor means for preventing hazardous access to said grinder, said second member and said first member being relatively movable with respect to each other to an "on" position such that in the "on" position said switch means is in the "on" condition whereby power may be provided for operation of said grinder, said second member including second restrictor means comprising at least one access-restricting arm.

* * * * *